US007387464B2

(12) United States Patent
Hall et al.

(10) Patent No.: US 7,387,464 B2
(45) Date of Patent: Jun. 17, 2008

(54) PAVEMENT TRIMMING TOOL

(76) Inventors: David R. Hall, 2185 S. Larsen Pkwy., Provo, UT (US) 84606; Joe Fox, 2185 S. Larsen Pkwy., Provo, UT (US) 84606

( * ) Notice: Subject to any disclaimer, the term of this patent is extended or adjusted under 35 U.S.C. 154(b) by 517 days.

(21) Appl. No.: 11/162,429

(22) Filed: Sep. 9, 2005

(65) Prior Publication Data

US 2006/0198703 A1 Sep. 7, 2006

Related U.S. Application Data

(63) Continuation of application No. 11/162,418, filed on Sep. 9, 2005, which is a continuation of application No. 11/070,411, filed on Mar. 1, 2005, now Pat. No. 7,223,049.

(51) Int. Cl.
*E01C 23/09* (2006.01)

(52) U.S. Cl. ..... 404/94; 404/87; 404/93

(58) Field of Classification Search ..... 404/87, 404/93, 94

See application file for complete search history.

(56) References Cited

U.S. PATENT DOCUMENTS

| | | | |
|---|---|---|---|
| 3,361,042 | A | 1/1968 | Cutler |
| 3,732,023 | A | 5/1973 | Rank |
| 3,970,404 | A | 7/1976 | Benedetti |
| 3,989,401 | A | 11/1976 | Moench |
| 4,018,540 | A | 4/1977 | Jackson |
| 4,104,736 | A | 8/1978 | Mendenhall |
| 4,124,325 | A | 11/1978 | Cutler |
| 4,172,679 | A | 10/1979 | Wirtgen |
| 4,195,946 | A | 4/1980 | Swisher |
| 4,335,975 | A | 6/1982 | Schoelkopf |
| 4,347,016 | A | 8/1982 | Sindelar |
| 4,407,605 | A | 10/1983 | Wirtgen |
| 4,453,856 | A | 6/1984 | Chiostri |
| 4,473,320 | A | 9/1984 | Register |
| 4,534,674 | A | 8/1985 | Cutler |
| 4,594,022 | A | 6/1986 | Jeppson |
| 4,668,017 | A | 5/1987 | Petersen |
| 4,676,689 | A | 6/1987 | Yant |
| 4,784,518 | A | 11/1988 | Cutler |
| 4,793,730 | A | 12/1988 | Butch |
| 4,968,101 | A | 11/1990 | Bossow |
| 5,366,320 | A | 11/1994 | Hanlon |
| 5,556,225 | A | 9/1996 | Marino |
| 5,765,926 | A | 6/1998 | Knapp |
| 5,791,814 | A | 8/1998 | Wiley |
| 6,158,920 | A | 12/2000 | Malot |
| 6,371,689 | B1 | 4/2002 | Wiley |
| 6,623,207 | B2 | 9/2003 | Grubba |
| 6,769,836 | B2 | 8/2004 | Llyod |

*Primary Examiner*—Raymond W Addie
(74) *Attorney, Agent, or Firm*—Daniel P. Nelson; Tyson J. Wilde

(57) ABSTRACT

An apparatus for degrading the periphery of a paved surface is disclosed in one aspect of the invention as including a support assembly, one or more pavement degradation tools coupled to the support assembly and adapted to degrade a paved surface, and a trimming tool coupled to the support assembly and adapted to degrade the edge created by the pavement degradation tools, thereby providing a desired contour to the edge. In selected embodiments, the trimming tool is adapted to straighten the edge created by the pavement degradation tools. The support assembly may be connected to a vehicle and adapted to laterally extend and retract the trimming tool with respect to the vehicle.

18 Claims, 15 Drawing Sheets

PAVEMENT TRIMMING TOOL

RELATED APPLICATIONS

This Patent application is a continuation-in-part of U.S. patent application Ser. No. 11/162,418 filed on Sep. 9, 2005, which is a continuation-in-part of U.S. patent application Ser. No. 11/070,411 filed on Mar. 1, 2005, and entitled "Apparatus, System, and Method for Directional Degradation of a Paved Surface."

BACKGROUND OF THE INVENTION

1. Field of the Invention

The present invention relates to apparatus, systems, and methods for excavating a paved surface and, more particularly, to apparatus, systems, and methods for excavating the periphery of a paved surface.

2. Background

Modern road surfaces typically comprise a combination of aggregate materials and binding agents processed and applied to form a smooth paved surface. The type and quality of the pavement components used, and the manner in which the pavement components are implemented or combined, may affect the durability of the paved surface. Even where a paved surface is quite durable, however, temperature fluctuations, weather, and vehicular traffic over a paved surface may result in cracks and other surface or sub-surface irregularities over time. Road salts and other corrosive chemicals applied to the paved surface, as well as accumulation of water in surface cracks, may accelerate pavement deterioration.

Road resurfacing equipment may be used to mill, remove, and/or recondition deteriorated pavement. In come cases, heat generating equipment may be used to soften the pavement, followed by equipment to mill the surface, apply pavement materials, and plane the surface. Often, new pavement materials may be combined with materials milled from an existing surface in order to recondition or recycle an existing paved surface. Once the new materials are added, the materials may be compacted and planed to restore a smooth paved surface.

Many conventional road milling machines are limited by the width of the cutting drum used on such machines. Most cutting drums comprise numerous cutting teeth mounted to a cylindrical drum to contact and mill the pavement surface as the machine travels forward. As a result, the width of the pavement area must be large enough to accommodate the cylindrical drum, and the area must normally be cleared of surface obstacles that may otherwise interfere with the cylindrical drum. Because the width of the cutting drum is fixed and the drum is normally dependent on the machine for its direction of travel, many conventional road cutting machines are ill-equipped to maneuver around obstacles such as underground utility lines and boxes, manholes and manhole covers, culverts, rails, curbs, gutters, and other obstacles found in modern roadways.

Because it may be inconvenient and costly to maneuver around or remove the above-stated obstacles before repaving or reconditioning a roadway, in some cases, a paved surface may be allowed to deteriorate until use of a conventional road cutting machine becomes appropriate. Before that time, the road may be temporarily patched or repaired to defray the costs associated with road resurfacing. Nevertheless, even when the roadway deteriorates to a point where reconditioning or repaving is necessary, many conventional road cutting machines may be unable to effectively perform certain tasks such as reconditioning or resurfacing peripheral pavement areas such as the road shoulder or the area around a manhole. In some instances, other devices such as jack hammers may be required. This may increase the costs and resources needed to recondition or repave a roadway.

Accordingly, what are needed are apparatus, systems, and methods to effectively degrade a paved surface, including peripheral areas of the paved surface, while reducing the costs normally associated therewith. Beneficially, such an apparatus, system, and method would be capable of avoiding surface obstacles, such as manholes, underground utilities, culverts, curbs, or the like, while also having the capability of degrading a wide swath of a road surface. Such apparatus, systems, and methods are disclosed and claimed herein.

SUMMARY OF THE INVENTION

The present invention has been developed in response to the present state of the art, and in particular, in response to the problems and needs in the art that have not yet been fully solved by currently available road reconstruction equipment. Accordingly, the present invention has been developed to provide an apparatus, system and method for degrading the peripheral areas of a paved surface that overcomes many or all of the above-discussed shortcomings in the art.

An apparatus for degrading the periphery of a paved surface is disclosed in one aspect of the invention as including a support assembly, one or more pavement degradation tools coupled to the support assembly and adapted to degrade a paved surface, and a trimming tool coupled to the support assembly and adapted to degrade the edge created by the pavement degradation tools, thereby providing a desired contour to the edge. In selected embodiments, the trimming tool is adapted to straighten the edge created by the pavement degradation tools.

In certain embodiments, the pavement degradation tools are independently moveable with respect to the trimming tool. Similarly, in some embodiments, the pavement degradation tools are adapted to oscillate independent of the trimming tool. In other embodiments, the trimming tool is adapted for at least one of perpendicular, lateral, and rotational movement relative to the support assembly.

In selected embodiments, the support assembly is connected to a vehicle and is adapted to laterally extend and retract the trimming tool with respect to the vehicle. The support assembly may include one or more hydraulic cylinders to extend and retract the pavement degradation tools and the trimming tool with respect to the vehicle. In certain embodiments, the trimming tool may degrade the edge in a direction substantially normal to its axis of rotation. The trimming tool may have a tool body comprising an outer circumference and various degradation inserts coupled to the outer circumference. These degradation inserts may include materials such as natural diamond, synthetic diamond, polycrystalline diamond, cubic boron nitride, or similar materials.

In another aspect of the invention, a system for degrading the periphery of a paved surface may include a vehicle, one or more pavement degradation tools coupled to the vehicle and adapted to degrade a paved surface, and a trimming tool coupled to the vehicle and adapted to degrade the edge created by the pavement degradation tools, thereby providing a desired contour to the edge.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order to describe the manner in which the above-recited features and advantages of the present invention are obtained, a more particular description of apparatus and methods in accordance with the invention will be rendered by reference to specific embodiments thereof, which are illustrated in the appended drawings. Understanding that the drawings depict only typical embodiments of the present invention and are not, therefore, to be considered as limiting the scope of the invention, apparatus and methods in accordance with the present invention will be described and explained with additional specificity and detail through the use of the accompanying drawings in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment in accordance with the present invention. Thus, use of the phrase "in one embodiment," "in an embodiment," and similar language throughout this specification may, but does not necessarily, all refer to the same embodiment.

Furthermore, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

In the following description, numerous specific details are disclosed to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

In this application, "pavement" or a "paved surface" refers to any artificial, wear-resistant surface that facilitates vehicular, pedestrian, or other form of traffic. Pavement may include composites containing oil, tar, tarmac, macadam, tarmacadam, asphalt, asphaltum, pitch, bitumen, minerals, rocks, pebbles, gravel, sand, polyester fibers, Portland cement, petrochemical binders, or the like. Likewise, the term "degrade" is used in this application to mean milling, grinding, cutting, ripping apart, tearing apart, or otherwise taking or pulling apart a pavement material into smaller constituent pieces.

Figure 1:
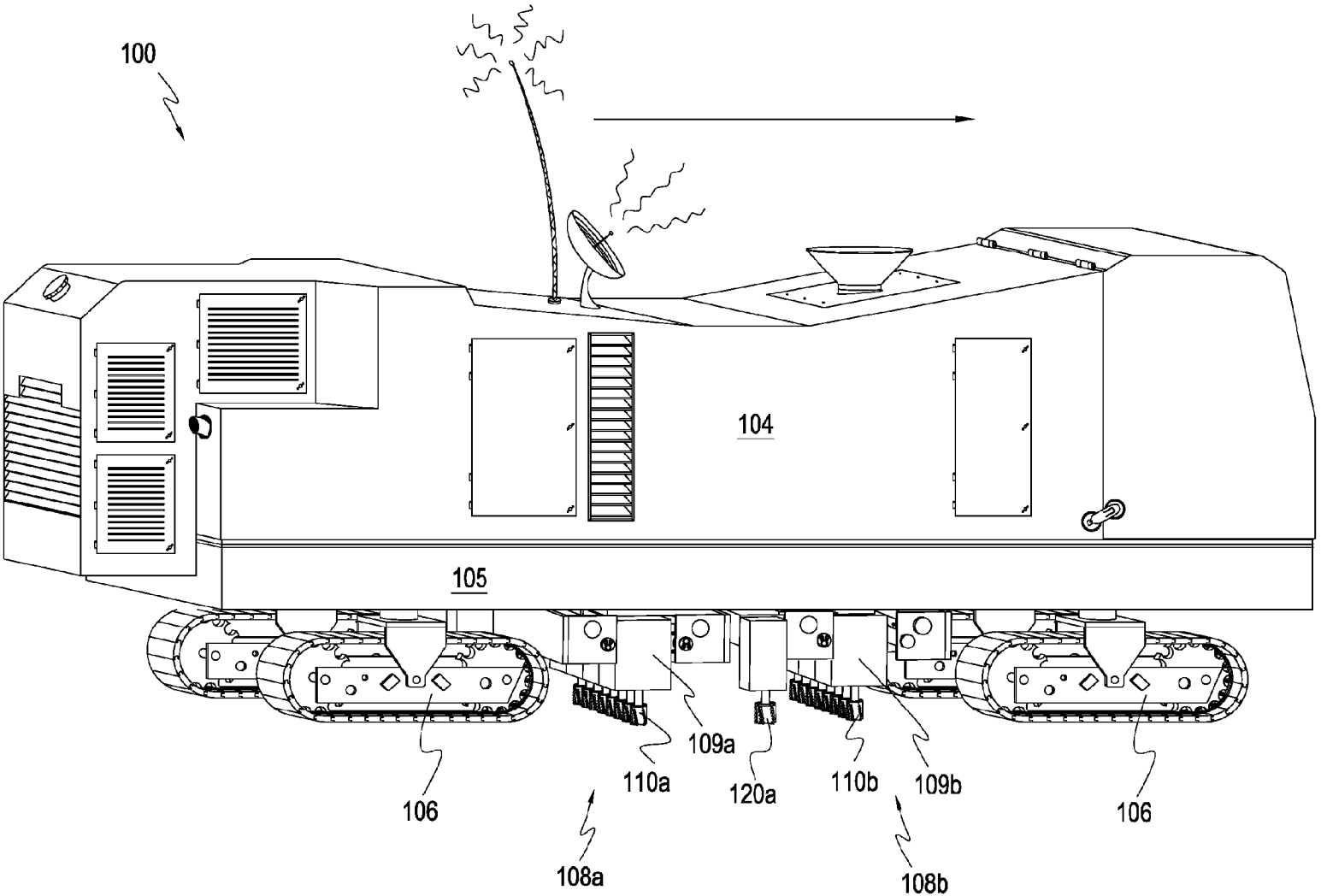
FIG. 1 is a perspective side view of one embodiment of a pavement degradation machine in accordance with the invention.
Figure 2:
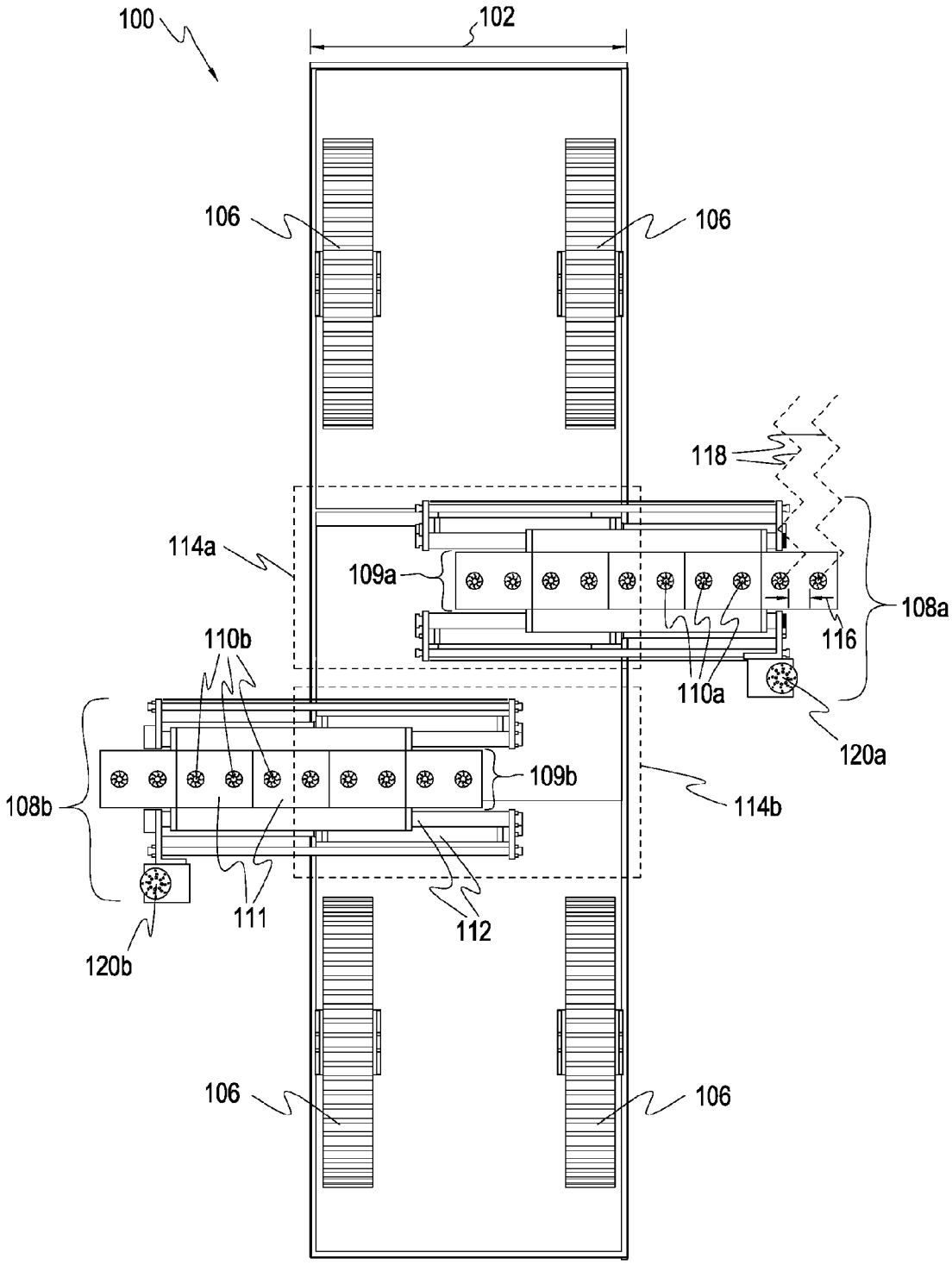
FIG. 2 is a bottom view of one embodiment of a pavement degradation machine in accordance with the invention.
Figure 3:
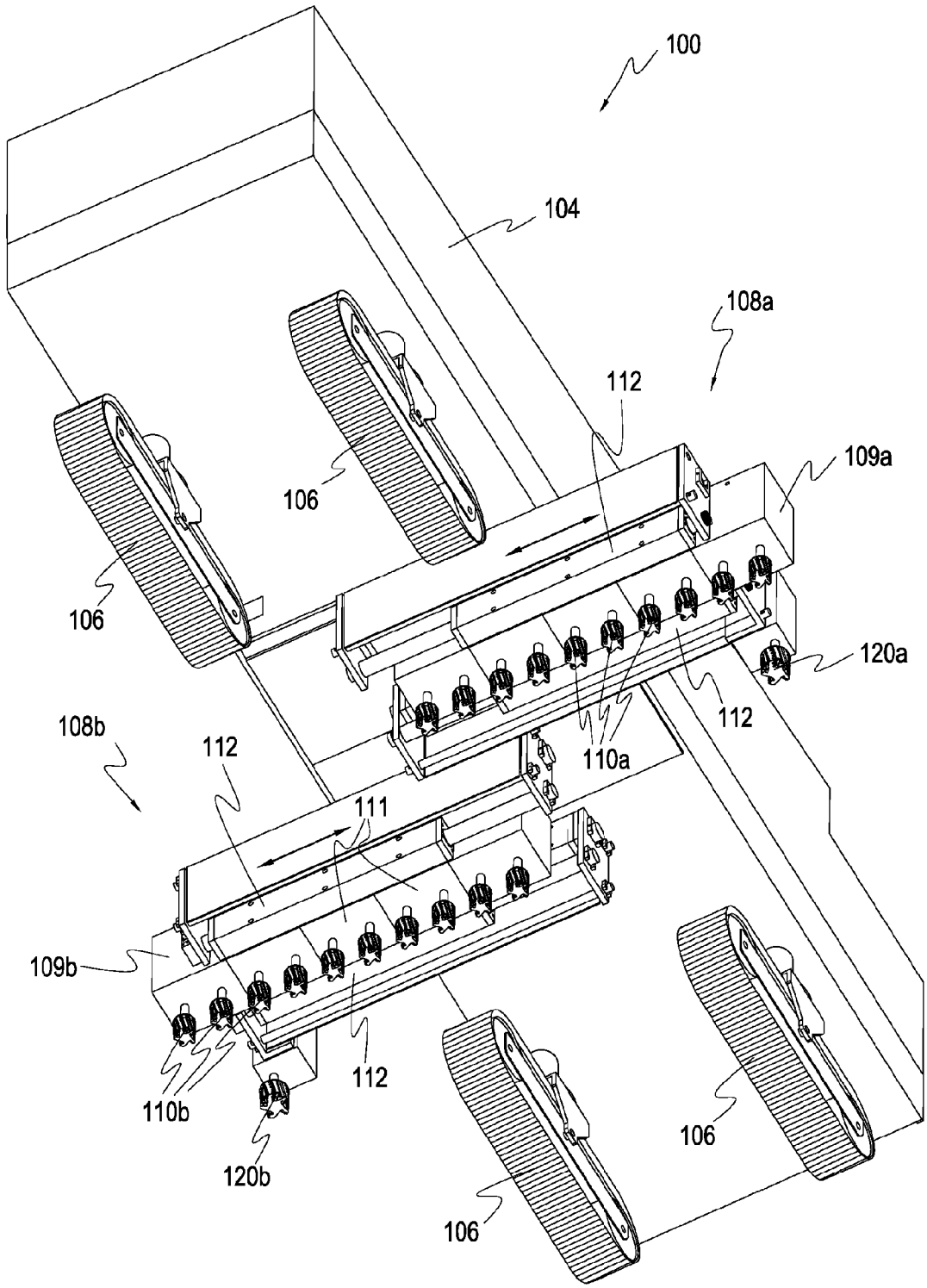
FIG. 3 is a bottom perspective view of one embodiment of a pavement degradation machine in accordance with the invention.

Referring collectively to FIGS. 1, 2, and 3, in selected embodiments, a pavement degradation machine 100 may be adapted to degrade a section of pavement substantially wider than the vehicle width 102. The pavement degradation machine 100 may include a shroud 104, covering various internal components of the pavement degradation machine 100, a frame 105, and a translation mechanism 106 such as tracks, wheels, or the like, to translate or move the machine 100, the likes of which are well known to those skilled in the art. The pavement degradation machine 100 may also include means for adjusting the elevation and slope of the shroud 104 and frame 105 relative to the translation mechanism 106 to adjust for varying elevations, slopes, and contours of the underlying road surface.

In selected embodiments, to allow degradation of a swath of pavement wider than the pavement degradation machine 100, the degradation machine 100 may include two or more support assemblies 108*a*, 108*b* that are capable of extending beyond the outer edge of the pavement degradation machine 100. Because the support assemblies 108*a*, 108*b* may be as wide as the vehicle itself, the extended support assemblies 108*a*, 108*b* may sweep over a width approximately twice the vehicle width 102. These assemblies 108*a*, 108*b* may include banks 109*a*, 109*b* of pavement degradation tools 110*a*, 110*b* that rotate about an axis substantially normal to the plane defined by the pavement. Each of these pavement degradation tools 110*a*, 110*b* may be used to degrade a paved surface in a direction substantially normal to their axes of rotation. In certain embodiments, the banks 109*a*, 109*b* may be divided up into one or more modular units 111 of one or more pavement degradation tools 110*a*, 110*b*.

To extend the support assemblies 108*a*, 108*b* beyond the outer edge of the pavement degradation machine 100, each of the support assemblies 108*a*, 108*b* may include actuators 112 such as hydraulic cylinders, pneumatic cylinders, or other mechanical devices known in the art to move the assemblies 108*a*, 108*b* from initial positions 114*a*, 114*b*, substantially centered beneath the machine 100, to the illustrated positions. In addition, because a specified distance 116 may exist between each of the pavement degradation tools 110*a*, 110*b*, the actuators 112 may allow the tools 110*a*, 110*b* to take a substantially zigzag or oscillating path (illustrated by the dotted lines 118) to allow the complete removal of pavement. This zigzag or oscillating path 118 may be accomplished by the side-to-side motion of the banks 109*a*, 109*b* of pavement degradation tool 110*a*, 110*b* in combination with either forward or rearward motion of the pavement degradation machine 100.

In certain embodiments, each of the support assemblies 108*a*, 108*b* may include trimming tools 120*a*, 120*b* similar in shape and function to the pavement degradation tools 110*a*, 110*b*. However, in contrast to the pavement degradation tools 110*a*, 110*b*, the trimming tools 120*a*, 120*b* may follow a relatively straight path as the pavement degradation machine 100 moves either in a forward or rearward direction and may be used to straighten or trim the zigzag edge created by the pavement degradation tools 110*a*, 110*b*. This may allow the trimming tools 120*a*, 120*b* to degrade pavement materials adjacent to curbs, gutters, barriers, shoulders, sidewalks, or other structures. Likewise, the support assemblies 108*a*, 108*b* may be adapted to allow the banks 109*a*, 109*b* of degradation tools 110*a*, 110*b* to zigzag or oscillate while the trimming tools 120*a*, 120*b* remain relatively fixed relative to the machine 100.

Figure 4:
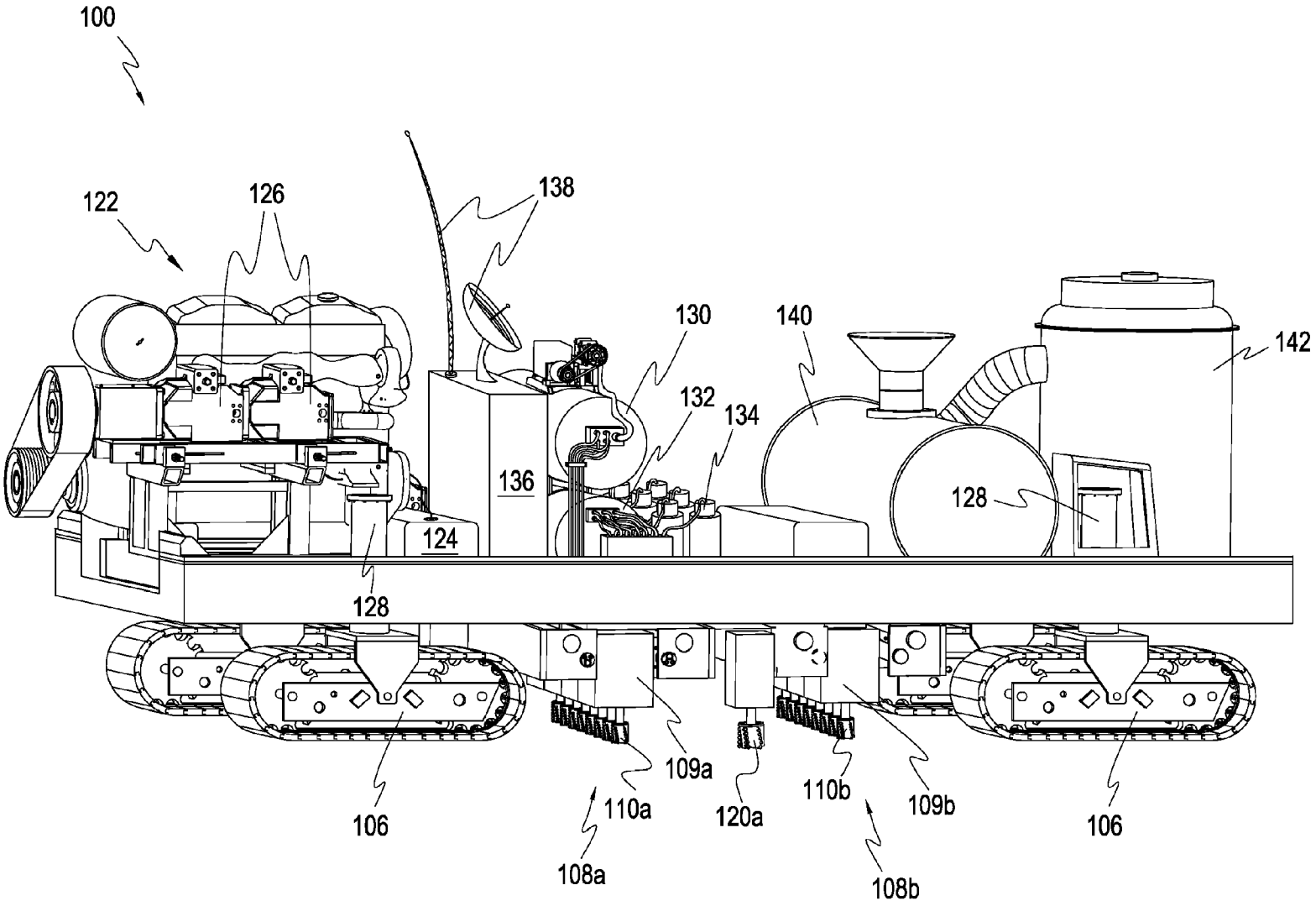
FIG. 4 is a perspective side view of one embodiment of a pavement degradation machine with the outer shroud removed.

Referring to FIG. 4, under the shroud 104, the pavement degradation machine 100 may include a variety of components to perform various features and functions. For example, in certain embodiments, the pavement degradation machine 100 may include an engine 122, such as a diesel or gasoline engine, to power the pavement degradation machine 100. The engine 122 may receive fuel from a fuel tank 124. In certain embodiments, the engine 122 may be used to drive one or more hydraulic pumps 126 which may drive hydraulic motors (not shown) for powering the translation mechanism 106. The hydraulic pumps 126 may also be used to drive one or more hydraulic cylinders 128, connected to the translation mechanism 106, for adjusting the level, slant, or elevation of the pavement degradation machine 100, or to compensate for variations in elevation and slope of the underlying road surface. The hydraulic pumps 126 may also be used to extend and retract the actuators 112 (referring back to FIG. 2) connected to the banks 109*a*, 109*b* of degradation tools 110*a*, 110*b*, in addition to driving hydraulic motors used to rotate the individual pavement degradation tools 110*a*, 110*b*.

In selected embodiments, the pavement degradation machine 100 may include an air compressor 130 to provide pneumatic power or an air supply to the pavement degradation machine 100. This may be used, in selected embodiments, to power the actuators 112, cool the pavement degradation tools 110*a*, 110*b*, clear debris from the area proximate the pavement degradation tools 110*a*, 110*b*, power pneumatic devices, or the like. Similarly, the pavement degradation machine 100 may include one or more tanks 132 to store hydraulic fluid and additional hydraulic pumps 134 to extend or retract the banks 109*a*, 109*b* of pavement degradation tools 110*a*, 110*b*, or the like. In certain embodiments, the pavement degradation machine 100 may include a computer or other electronic equipment 136 to control and/or monitor the pavement degradation machine 100, and to communicate with various remote sources, including but not limited to radio, satellite, cellular, Internet, cache or other sources. In selected embodiments, the computer and electronic equipment 136 may communicate wirelessly with these remote sources by way of one or more antennas 138. Such a system may permit the pavement degradation machine 100 to be controlled or monitored remotely, or allow data to be uploaded or downloaded to the pavement degradation machine 100, as needed.

In certain embodiments, such as where the pavement degradation machine 100 is used in a process to recycle materials excavated from an existing paved surface, the pavement degradation machine 100 may optionally include a hopper 140 and/or a tank 142. The hopper 140 and tank 142 may store rejuvenation or renewal materials that may be mixed with materials excavated from the road surface. The resulting mixture may then be applied to the road surface to create a recycled surface. Rejuvenation or renewal materials that may be stored in the hopper 140, tank 142, or both, to be used in a recycling process may include, for example, oil, tar, tarmac, macadam, tarmacadam, asphalt, asphaltum, pitch, bitumen, minerals, rocks, pebbles, gravel, sand, polyester fibers, Portland cement, petrochemical binders, or the like. In selected embodiments, the hopper 140 is used to store dry materials, such as rocks and gravel, where as the tank 142 is used to store liquids, such as oil and tar.

Figure 5:
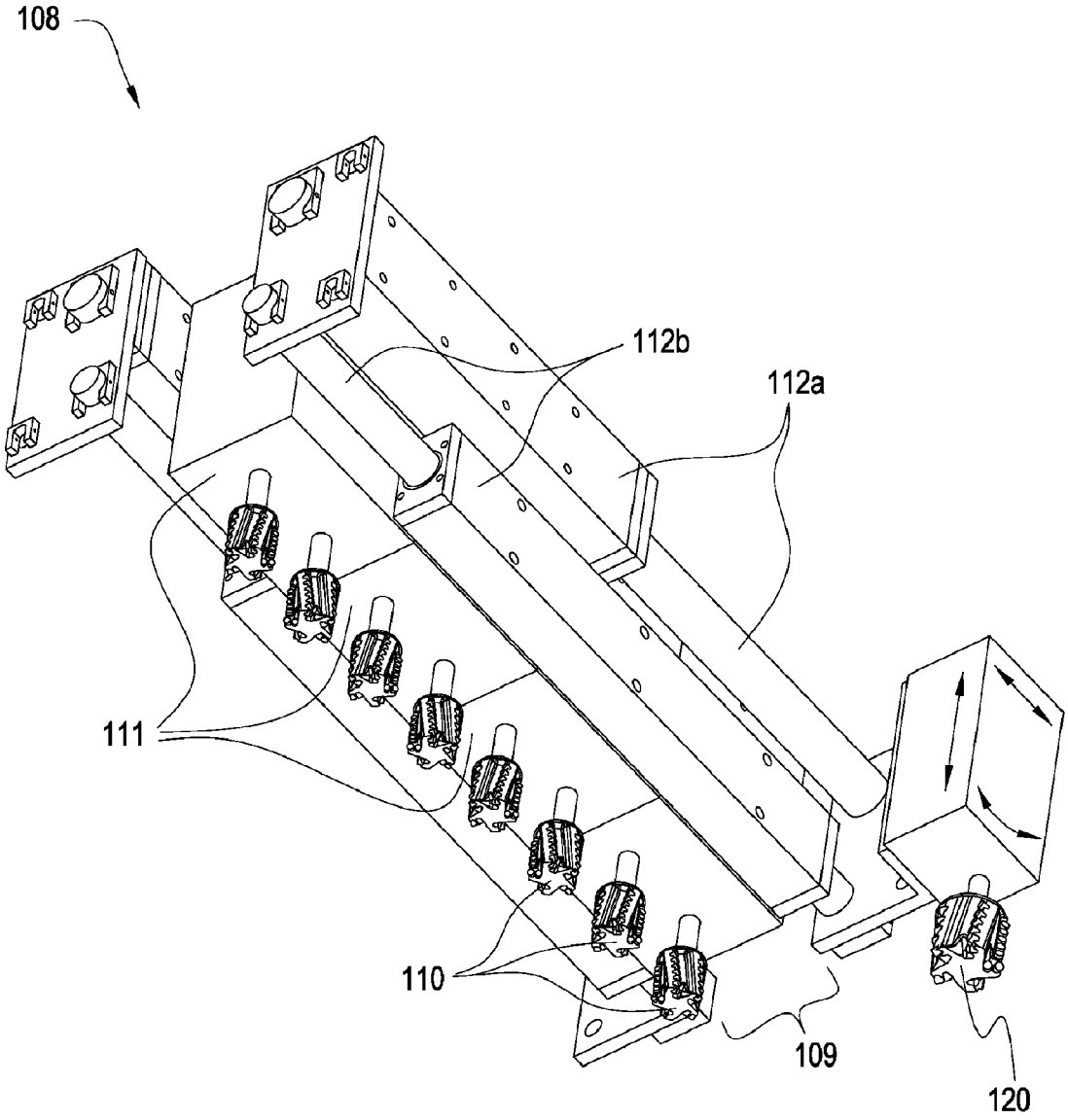
FIG. 5 is a perspective view of one embodiment of a support assembly comprising a bank of pavement degradation tools.

Referring to FIG. 5, a support assembly 108 may include a bank 109 of one or more degradation tools 110. The pavement degradation tools 110 may be grouped together in a bank 109 to allow the tools 110 to degrade a wider area than would be possible using any tool 110 individually, and to allow the tools 110 to share a common power source. In certain embodiments, the bank 109 may be divided up into smaller modular units 111 of two or more pavement degradation tools 110. The pavement degradation tools 110 may be mechanically linked together with gears, as will be explained in more detail with respect to FIGS. 7 through 10B, such that rotation of one causes the rotation of the other. These gears, if uniform in size, may allow the tools 110 to rotate at a uniform speed.

In some embodiments of the invention, the banks 109 may be detachable as a whole from the actuators 112 for repair and maintenance. A repair vehicle (not shown) may be nearby which carries spare banks 109 equipped with degradation tools 110. In the event that a bank 109 is desired to be replaced; temporally or permanently; the bank 109 may be detached from the actuators 112 and placed in the repair vehicle, while the spare bank may be attached to the actuators 112.

In selected embodiments, the support assembly 108 may employ various actuators 112*a*, 112*b* such as hydraulic or pneumatic cylinders 112*a*, 112*b*, to extend and retract the bank 109 of pavement degradation tools 110, as well as the trimming tool 120, with respect to the pavement degradation machine 100. For example, the rectangular portion of a first actuator 112*a* may be rigidly connected to the undercarriage of the pavement degradation machine 100 and may allow the entire support assembly 108, including the bank 109 of degradation tools 110 and the trimming tool 120, to be extended and retracted with respect to pavement degradation machine 100. The rectangular portion of a second actuator 112*b* may be rigidly connected to the bank 109 of pavement degradation tools 110 and may allow the bank 109 to oscillate back and forth with respect to the rest of the support assembly 108. The actuators 112*a*, 112*b* may also allow the trimming tool 120 to be extended and retracted with respect to the pavement degradation machine 100 independent of the pavement degradation tools 110, and vice versa. As will be explained in more detail with respect to FIGS. 12 through 14, in selected embodiments the trimming tool 120 may be adapted for lateral, perpendicular, or rotational movement relative to the support assembly 108.

Figure 6:
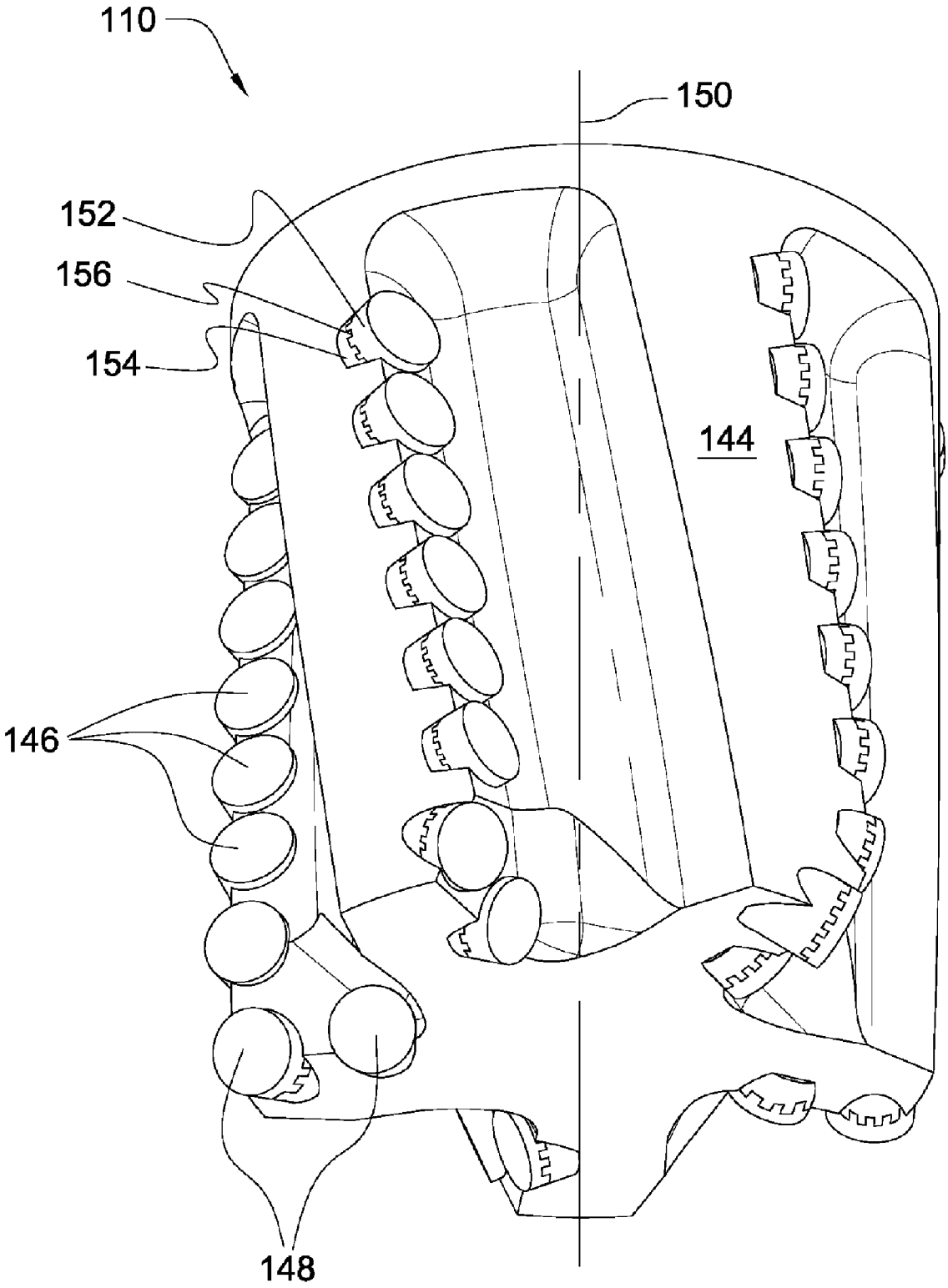
FIG. 6 is a perspective view of one embodiment of a pavement degradation tool.

Referring to FIG. 6, in general, each of the pavement degradation tools 110 may include a helically grooved tool body 144 which may be constructed of various materials such as high-strength steel, hardened alloys, metal carbides, cemented metal carbide, or other suitable material known to those in the art. In certain embodiments, the tool body 144 may also include a surface coating such as ceramic, steel, ceramic-steel composite, steel alloy, bronze alloy, tungsten carbide, polycrystalline diamond, cubic boron nitride, or other heat-tolerant, wear-resistant surface coating known to those in the art. The tool body 144 may also, in certain embodiments, receive an anti-balling treatment for degrading sticky or tacky pavement materials.

Degradation inserts 146 may be coupled to the tool body 144 to make contact with and degrade a paved surface. In certain embodiments, various degradation inserts 148 near the bottom of the tool 110 may be tilted downward to allow the tool 110 to vertically plunge into a paved surface. The tool 110 may then be in position to degrade the pavement in a direction normal to the tool's axis of rotation 150 using degradation inserts 146 along the outer circumference of the tool 110.

The degradation inserts 146 may include a cutting layer 152, to directly contact the pavement, bonded to an underlying substrate 154. The substrate 154 may be manufactured from a material such as tungsten carbide, high-strength steel, or other suitable material known to those skilled in the art. The cutting layer 152 may include natural diamond, synthetic diamond, polycrystalline diamond, cubic boron nitride, a composite material, or other suitable material known to those in the art. The cutting layer 152 may, in some embodiments, be composed of smaller crystals or pieces that may vary in size to promote wear resistance, impact resistance, or both. In certain embodiments, to manage heat that may be present while degrading pavement, the cutting layer 152 may comprise thermally stable polycrystalline diamond or partially thermally stable polycrystalline diamond. The interface 156 between the cutting layer 152 and the substrate 154 may assume various different textures, shapes, or features to provide a strong and resilient bond between the cutting layer 152 and the substrate 154.

For a detailed description of a pavement degradation tools 110 that may be used in a pavement degradation machine 100 in accordance with the invention, the reader is referred to U.S. patent application Ser. No. 11/070,411 and entitled "Apparatus, System, and Method for Directional Degradation of a Paved Surface," having common inventors with the present invention, to which this application claims priority and incorporates by reference in its entirety.

Figure 7:
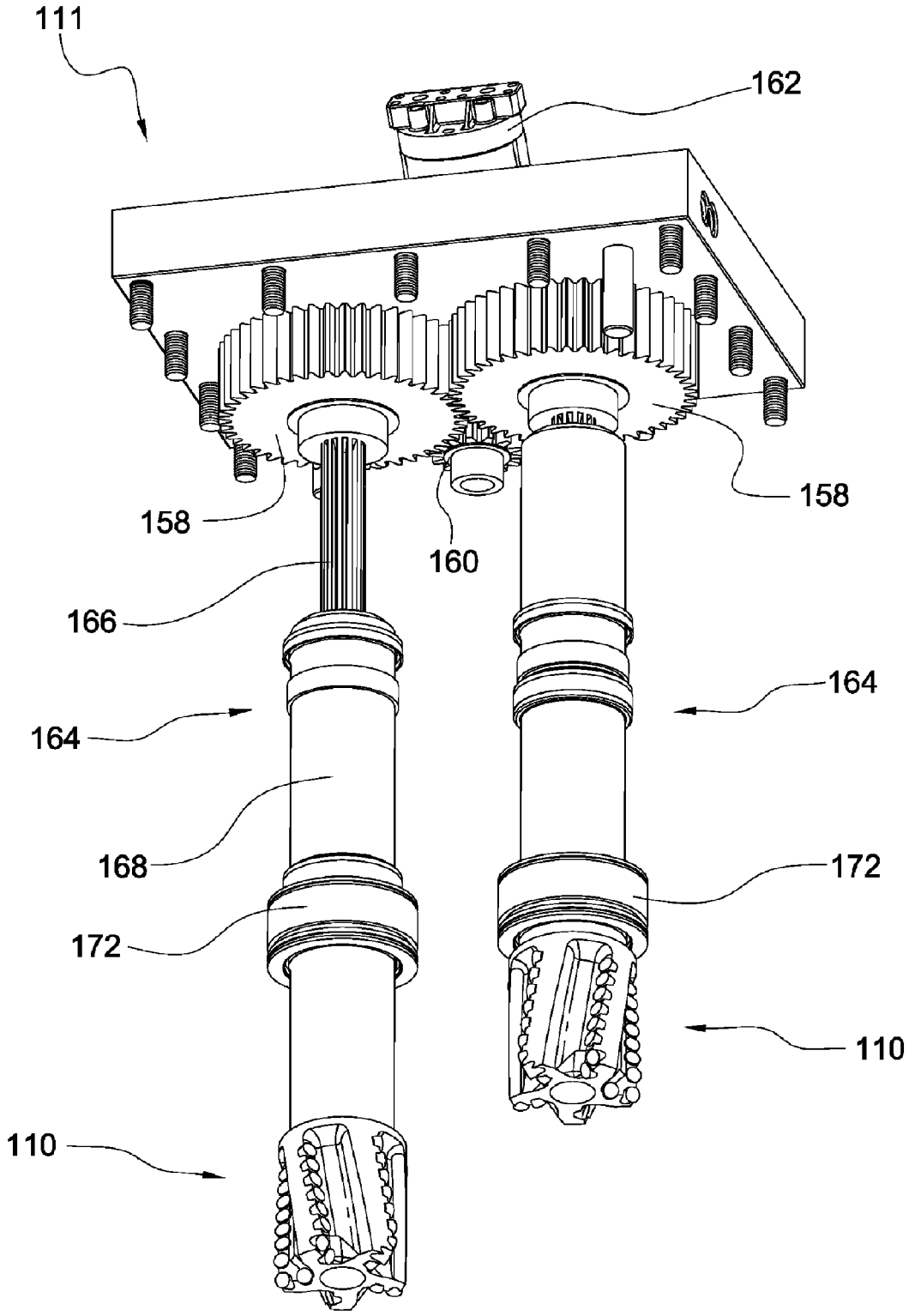
FIG. 7 is a perspective view of one embodiment of a pair of pavement degradation tools in a ganged configuration.
Figure 8:
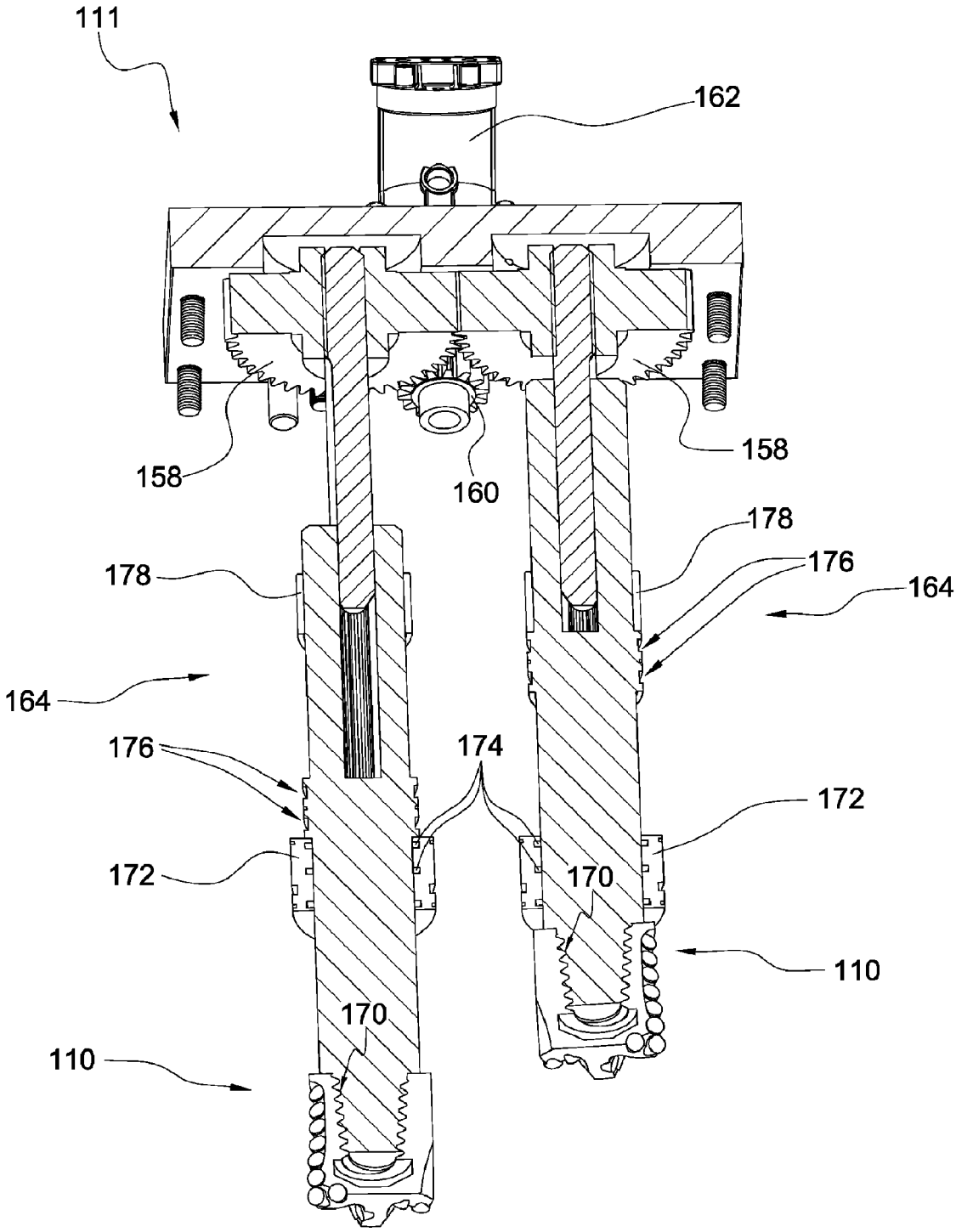
FIG. 8 is a cross-sectional perspective view of the pair of pavement degradation tools illustrated in FIG. 7.

Referring to FIGS. 7 and 8 collectively, one embodiment of a modular unit 111 of two pavement degradation tools 110 is illustrated. In certain embodiments, the pavement degradation tools 110 may be grouped together in modular units 111 to allow the pavement degradation tools 110 to share a common power source, be mechanically linked together, be grouped into smaller replaceable or repairable units, add structural support to the tools 110, or the like. As illustrated, the outer housing (not shown) of the modular unit 111 has been removed to show one embodiment of the internal workings of a modular unit 111 in accordance with the invention.

As discussed above, in certain embodiments, the pavement degradation tools 110 may be mechanically linked together such that rotation of one causes rotation of the other. For example, in certain embodiments, the tools 110 may be connected to a pair of intermeshed gears 158 to transfer rotary motion therebetween. The gears 158, and thus the pavement degradation tools 110, rotate in opposite directions. "Ganging" the gears together in this manner may provide several advantages. For example, because the gears 158 rotate in opposite directions, pavement materials broken up by the pavement degradation tools 110 may be drawn into the space between the tools 110. This may provide an efficient flow of material away from the area of pavement degradation. Although the mechanical linkage in the illustrated embodiment comprises gears 158, one of ordinary skill in the art will recognize that chains, belts, or other mechanisms may also be used to mechanically link the rotation of one pavement degradation tool 110 to another. Thus, these types of linkages also fall within the scope of the present invention and the appended claims.

Ganging the gears 158 together may also allow a single power source to provide power to multiple pavement degradation tools 110. For example, in certain embodiments, a drive gear 160 may engage one of the gears 158 to drive both of the pavement degradation tools 110. The drive gear 160 may be driven by a power source 162 such as a hydraulic, pneumatic, electric, fuel-burning, or other motor. Due to the ganged configuration, the pavement degradation tools 110 may share the total power output by the power source 162. Thus, in situations where one pavement degradation tool 110 requires more power than another, this configuration may allow each tool 110 to consume a different amount of power. In some cases, the total power supplied by the power source 162 may remain relatively constant while the power allocated to each tool 110 may differ.

In certain embodiments, the pavement degradation tools 110 and the gears 158 may be connected to an extendable shaft 164, such as a two-piece splined shaft 164. A splined shaft 164 may include a first section 166 having external splines and a second section 168 having internal splines. These splines may allow the first section 166 to slide into the second section 168 while preventing the rotation of the first section 166 relative to the second section 168.

The extendable shaft 164 may enable independent or joint displacement of selected pavement degradation tools 110 in a vertical direction. This may be helpful in allowing the pavement degradation tools 110 to conform to the contour of the pavement surface or to avoid obstructions such as manholes, culverts, curbs, gutters, utilities, pipes, sensors, or other obstructions in the roadway. The vertical displacement of selected pavement degradation tools 110 may be manually controlled by the machine operator or, in other contemplated embodiments, may be automatically controlled by sensors or other devices capable of detecting and responding to roadway structures or obstacles. Likewise, the vertical displacement of each tool 110 may be actuated by hydraulic, pneumatic, electrical, or other means known to those of skill in the art.

In certain embodiments, a pavement degradation tool 110 may be attached to the shaft 164, for example, by way of internal and external threads 170 on the shaft 164 and the pavement degradation tool 110. In certain embodiments, the direction of the threads 170 may be designed such that the rotational direction of the tool 110 actually tightens the threaded connection. Furthermore, in certain embodiments, the threaded connection 170 may be tapered to allow for easier and faster removal or installation of a pavement degradation tool 110.

The extendable shaft 164 may ride against a bearing 172 or bushing 172 to provide a point of contact between the rotating shaft 164 and the non-rotating housing (not shown). Bearings 172 and bushings 172 suitable for use with the present invention may include bushings, roller bearings, ball bearings, needle bearings, sleeve bearings, thrust bearings, linear bearings, tapered bearings, or combinations thereof. In certain embodiments, the shaft 164 may be polished or finished to provide a surface to ride against the bearing 172 or bushing 172.

The bearing 172 or bushing 172 may include one or more seals 174 to prevent the escape of fluids from inside the modular unit 111 and likewise prevent unwanted materials from entering the modular unit 111. The shaft 164 may also include various locations for seals 176. In hydraulic or pneumatic systems, the seals 174, 176 may also provide a sealed chamber to facilitate hydraulic or pneumatic actuation of the pavement degradation tools 110 in a vertical direction. Because the pavement degradation tools 110 may be displaced in a vertical direction, the bearings 172, bushings 172, or other sleeves 178 or characteristics of the shaft 164 and bank housing (not shown) may limit the vertical travel of the pavement degradation tools 110 to a desired travel distance.

Figure 9:
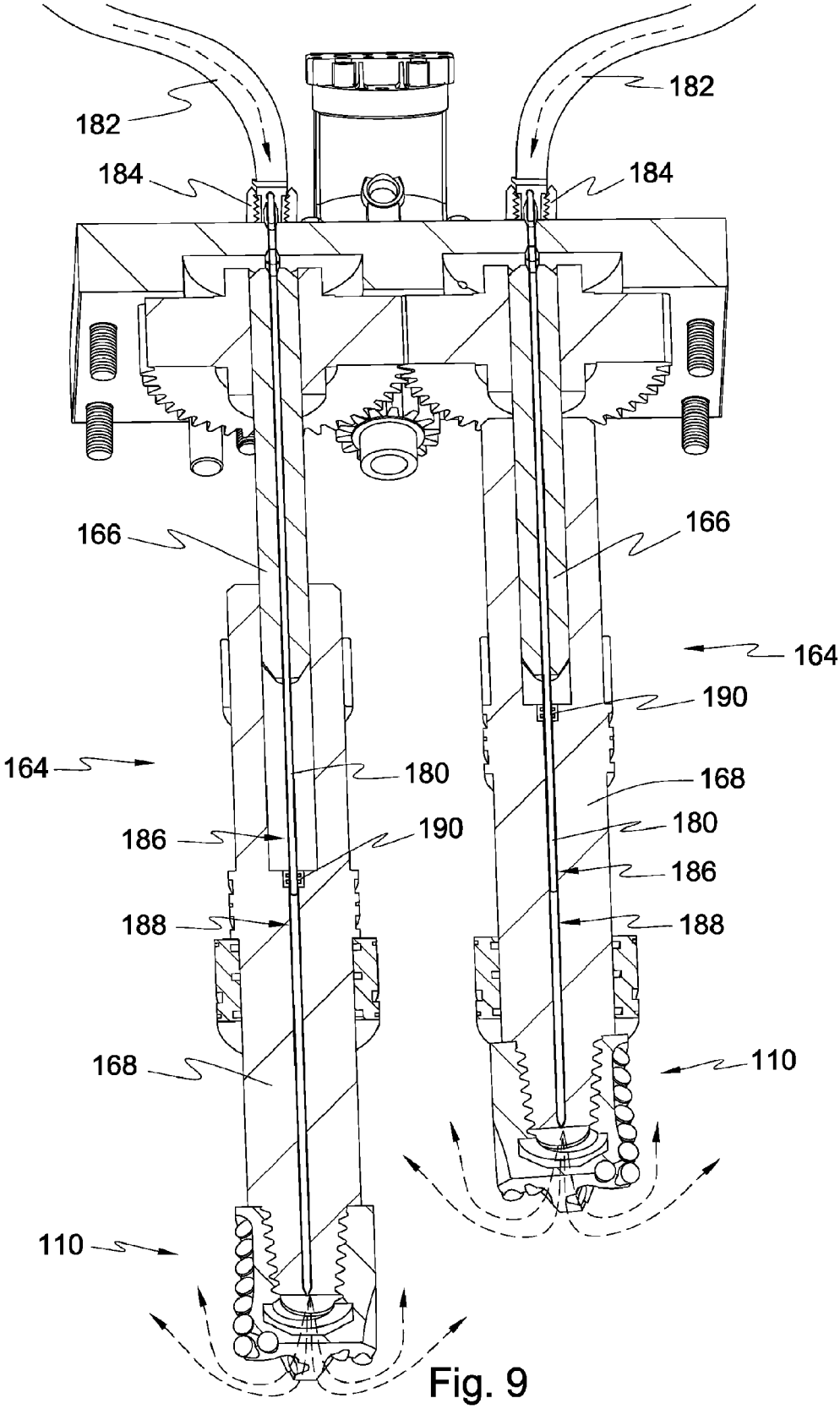
FIG. 9 is a perspective view of one embodiment of a pair of pavement degradation tools in a ganged configuration, comprising channels passing therethrough.

Referring to FIG. 9, in selected embodiments, a channel 180 may be bored or otherwise formed through the shaft 164. In certain embodiments, a fluid such as air, water, or the like may be forced through the channel 180 to cool the pavement degradation tools 110, to clear pavement fragments away from the pavement degradation tool 110, or for other purposes. In other embodiments, such as in recycling applications, rejuvenation or other renewal materials, such as oil or tar, may be forced through the channel 180 to be mixed with pavement fragments dislodged by the pavement degradation tools 110. The channels 180 may interface with a supply line 182 by way of a coupling 184 or fitting 184.

In certain embodiments, where the shaft 164 is a two-piece extendable shaft 164, a channel 180 may include a tube 186 and a bore 188. The tube 186 may be fixed with respect to the externally splined portion 166 of the shaft 164. Similarly, the bore 188 may be formed in the internally splined portion 168 of the shaft 164. As the shaft 164 is extended, the tube 186 may slide through the bore 188 to lengthen the channel 180. A seal 190 may be used to seal the interface between the tube 186 and the bore 188.

Figure 10A:
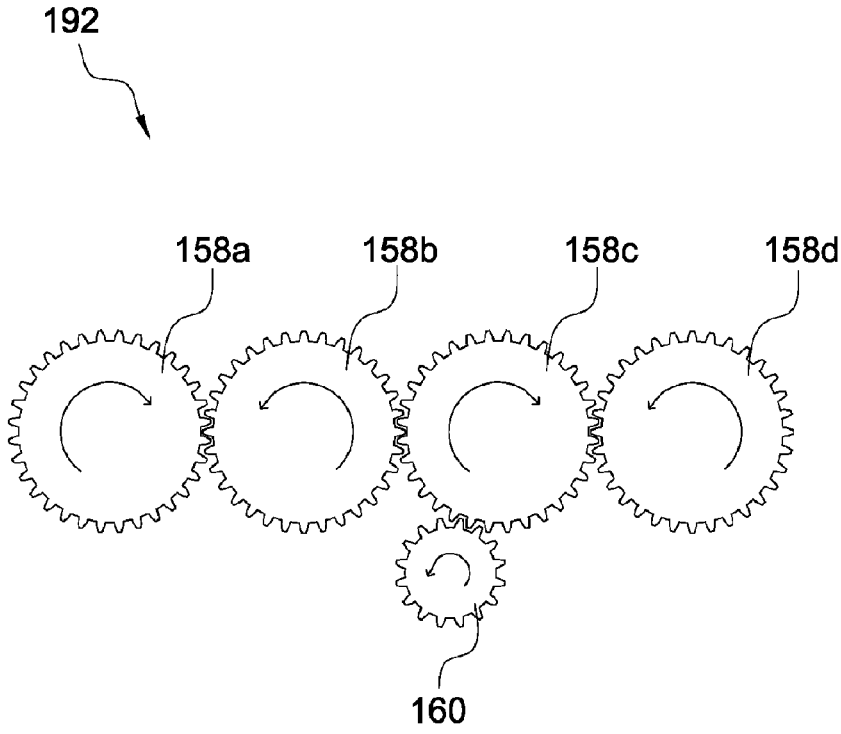
FIG. 10A is a diagram illustrating a gear train in a linear configuration for use in ganging two or more pavement degradation tools together.

Referring to FIG. 10A, while continuing to refer generally to FIGS. 7 and 8, in selected embodiments, two or more gears 158*a-d* may be "ganged" together to form a gear train 192. Each of the gears 158*a-d* may be connected to a pavement degradation tool 110 and adjacent gears rotate in opposite directions. In certain embodiments, a drive gear 160 may be used to drive one of the gears 158*a-d*. Depending on the size of the drive gear 160 and the size of the gears 158*a-d*, the gear ratio may be adjusted to provide a desired rotational speed, torque, or the like. In other embodiments, a power source may drive a single gear 158*a-d* directly. For example, a power source may be connected directly to the shaft or axis of rotation of one of the gears 158*a-d*. In some embodiments, the drive gear 160 may be part of a manual or automatic transmission system, which is capable of interchanging a plurality of drive gears 160 of varying sizes to adjust the gear ratio while the gear train is in operation.

As was previously discussed, a gear train 192 may be advantageous in that a single power source may be used to drive multiple gears 158*a-d*. The total power provided by a power source may be allocated among all of the gears 158*a-d*, although not necessarily equally. For example, depending on the characteristics and uniformity of the pavement material being degraded, some gears 158*a-d* may require more torque than others and thus, may require and use more power. This concept will be described with additional specificity in the description of FIG. 11.

Figure 10B:
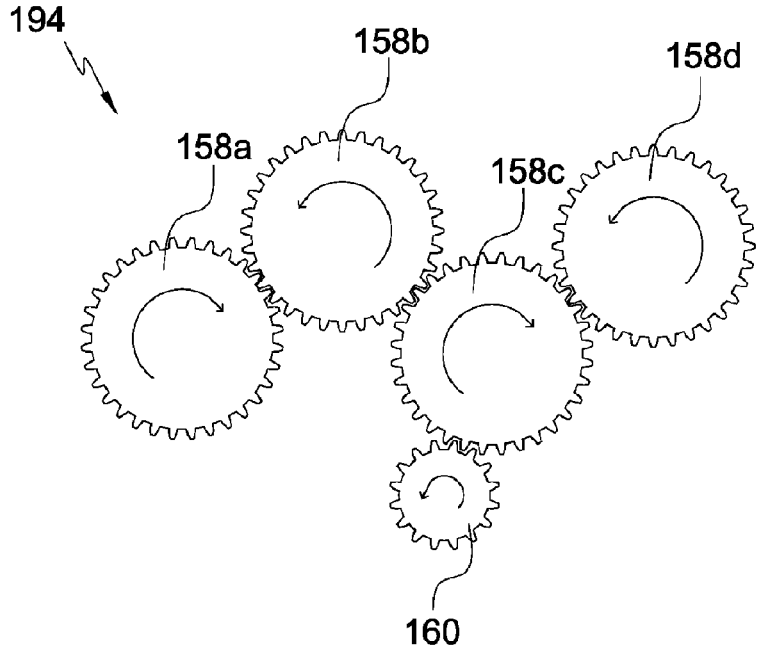
FIG. 10B is a diagram illustrating a gear train in a non-linear configuration for use in ganging two or more pavement degradation tools together.

Referring to FIG. 10B, while continuing to refer generally to FIGS. 7 and 8, in other embodiments, the gears 158*a-d* may be offset, or staggered, to form a gear train 194. Like the previous example, each of these gears 158*a-d* may be connected to a pavement degradation tool 110. One advantage of this offset or "staggered" configuration is that the pavement degradation tools 110 may be located closer together and thus, degrade a paved surface without the need to oscillate from side-to-side to the same extent as the configuration illustrated in FIG. 10A.

Figure 11:
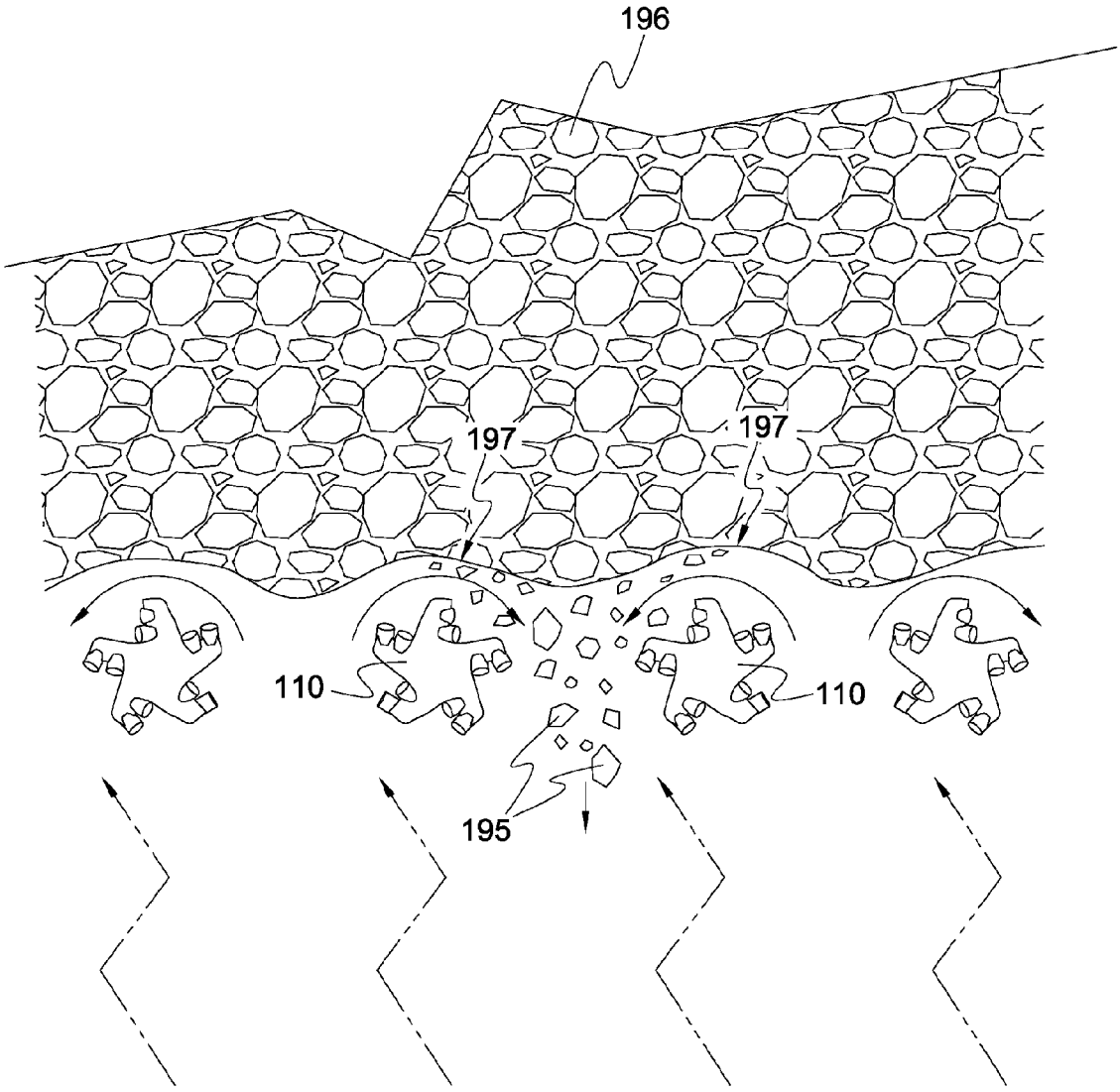
FIG. 11 is a diagram illustrating one example of the operation of pavement degradation tools in a ganged configuration.

Referring to FIG. 11, ganging the gears 158 together such that adjacent gears rotate in opposite directions may be advantageous for several reasons. First, as the pavement degradation tools 110 are degrading a paved surface, cuttings 195 or pieces of pavement material may be swept between pairs of pavement degradation tools 110. This may facilitate the removal of materials away from area where the pavement degradation tools 110 interface with the pavement 196 and may ensure that the pavement degradation tools 110 work together. If, for example, the pavement degradation tools were to all turn the same direction, one tool 110 would likely sweep cuttings toward another tool 110, potentially interfering with the cutting process and causing the cuttings 195 to accumulate at or near the cutting interface 197.

Second, some pavement materials may exhibit inconsistent characteristics, such as harder or softer areas, which may depend on factors such as aggregate size, density, hardness, the relative proportion of aggregate to binding material, or other factors. As a result, at times, some pavement degradation tools 110 may require different amounts of power or torque than others to degrade a comparatively harder or softer area. Due to the unique "ganged" configuration of the pavement degradation tools 110, more power may be allocated to those tools 110 that require it.

Finally, by designing the banks 109 such that adjacent pavement degradation tools 110 rotate in opposite directions, the tools 110 may be balanced. That is, if the pavement degradation tools 110 were to rotate in the same direction, the pavement degradation tools 110 would tend to "walk" in one direction when contacting and degrading the pavement 196. This would place an extreme amount of stress on the support assembly 108 and would likely create an unbalanced condition. By designing the banks 109 such that the degradation tools 110 rotate in opposite direction, the force generated by each pavement degradation tool 110 cancels out the force generated by an adjacent tool 110. Thus, the net force on the bank 109 is approximately zero (assuming an even number of pavement degradation tools 110), and the bank 109 may be stabilized.

Figure 12:
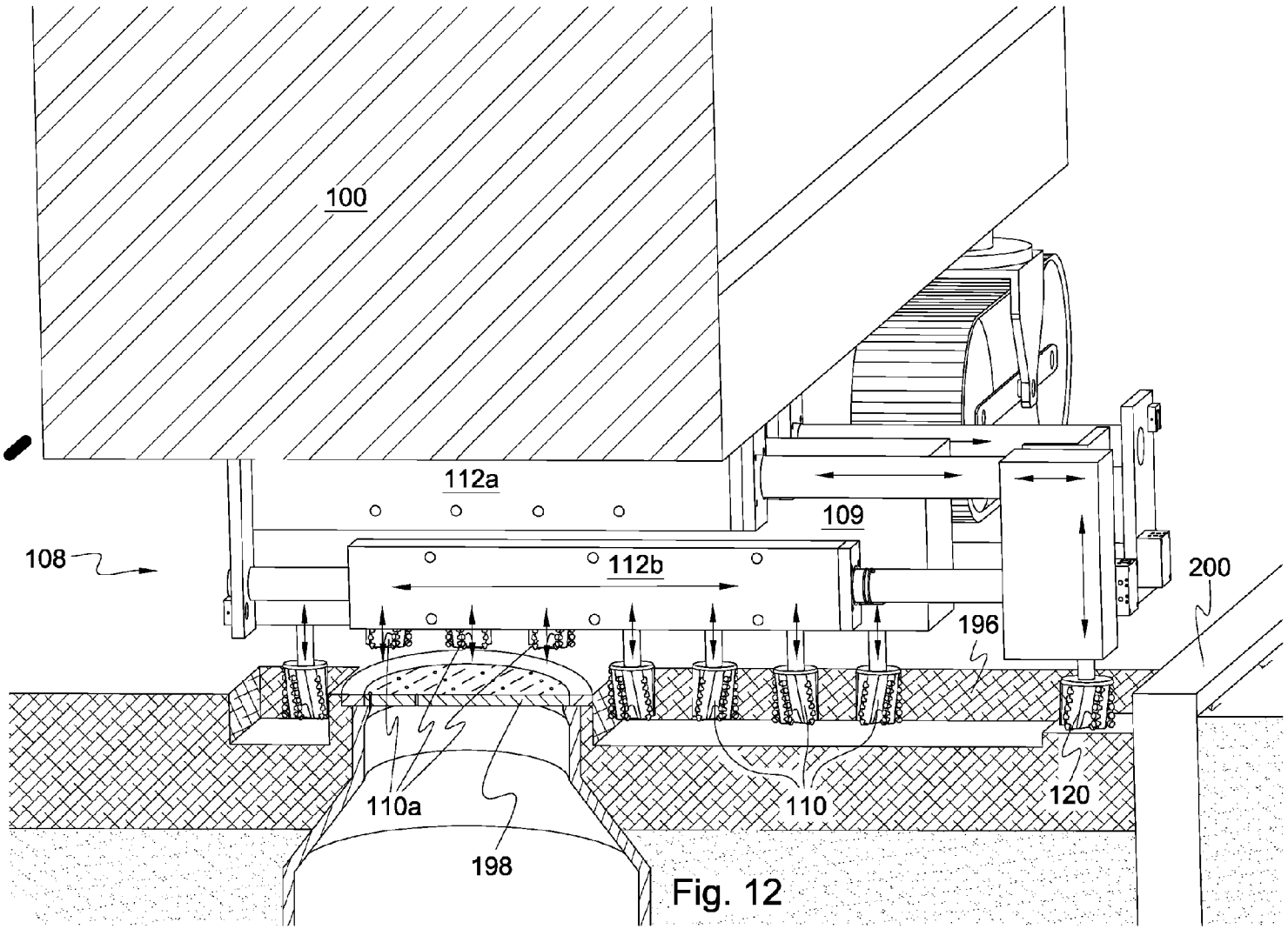
FIG. 12 is cutaway perspective view showing vertical movement of the pavement degradation tools and a trimming tool in accordance with the invention.

Referring to FIG. 12, as was previously mentioned with respect to FIG. 5, a support assembly 108 may include a first actuator 112*a* rigidly connected to the undercarriage of a pavement degradation machine 100. This actuator 112*a* may be used to extend and retract the support assembly 108 with respect to the pavement degradation machine 100 (here, the support assembly is shown extended to the right). A second actuator 112*b* may be rigidly attached to a bank 109 of pavement degradation tools 110 and may be used to slide the bank 109 back and forth with respect to the support assembly 108, such as in an oscillating motion. This may allow the pavement degradation tools 110 to degrade a paved surface 196 as the machine 100 moves in a forward or rearward direction.

Furthermore, as was mentioned with respect to FIGS. 7 and 8, in certain embodiments the pavement degradation tools 110 may be independently or jointly displaced in a vertical direction to conform to the contour of the pavement surface or to avoid obstructions such as manholes 198, culverts, curbs, gutters, utilities, pipes, sensors, or other obstructions in the roadway. In this example, several pavement degradation tools 110*a* are raised vertically to avoid a manhole 198. This displacement may be controlled manually by a machine operator or, alternatively, automatically using sensors or other devices placed at various locations on the pavement degradation machine 100.

A trimming tool 120 may be located proximate an end of the support assembly 108 and may be used to straighten or clean up an edge created by the pavement degradation tools 110 or may be used to degrade a paved surface proximate a curb 200 or other structure 200. In selected embodiments, instead of being rigidly fixed to the support assembly 108, the trimming tool 120 may be adapted for lateral, perpendicular, or rotational movement relative to the support assembly 108. This movement may be actuated by hydraulic, pneumatic, electrical, or other suitable means known to those of skill in the art. In alternative embodiments, the trimming tool 120 may be implemented on a different support assembly 108 than the pavement degradation tools 110 and may either precede or follow the pavement degradation tools 110.

Figure 13:
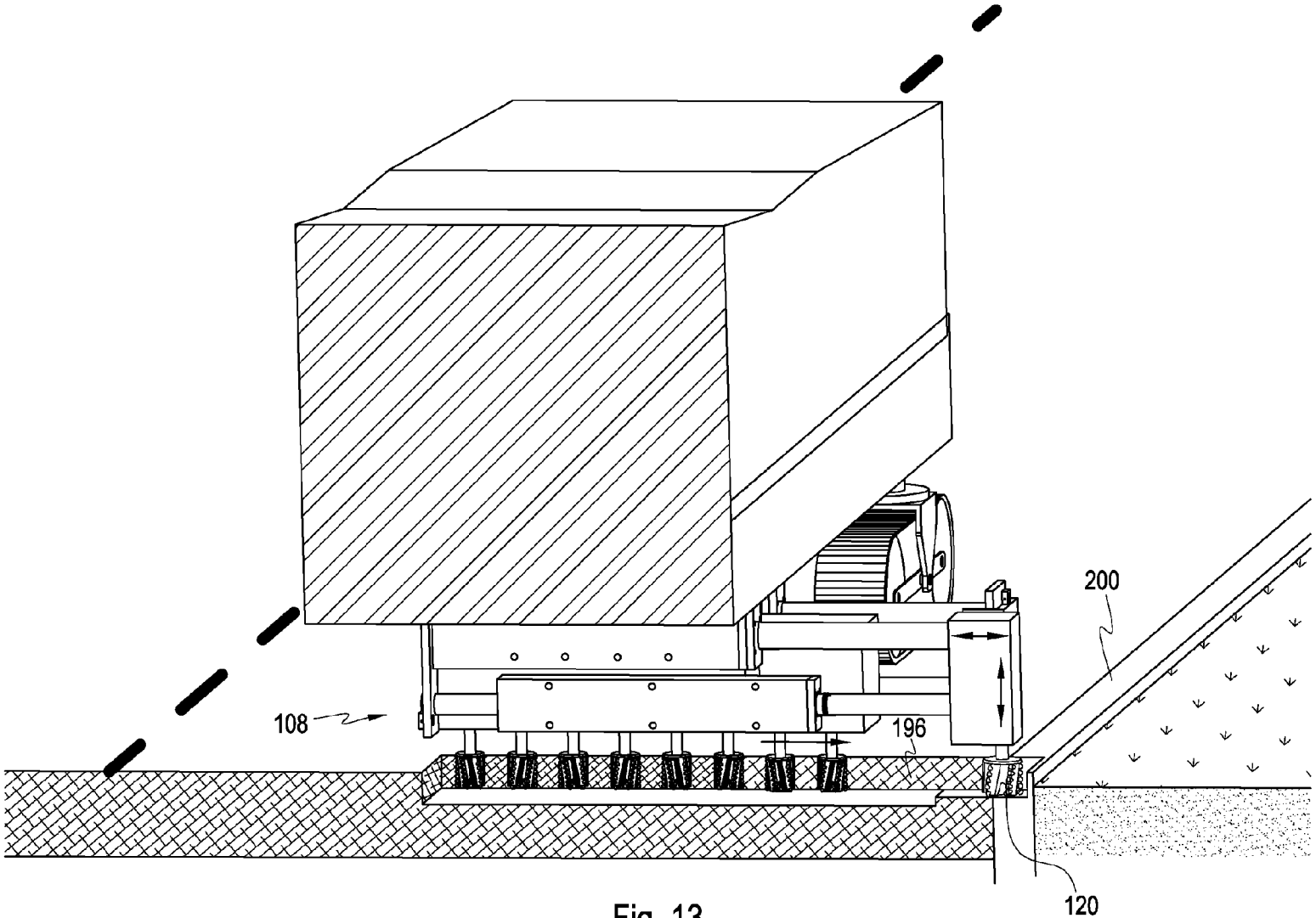
FIG. 13 is cutaway perspective view showing a trimming tool degrading a curb or other peripheral structure.

Referring to FIG. 13, for example, in selected embodiments the trimming tool 120 may be actuated laterally with respect to the support assembly 108 to cut into a curb 200 or other structure 200, or to provide a desired contour to the edge of the pavement 196. This feature may be used to cut driveways, walkways, drainage paths, or other characteristics into a curb, sidewalk, or other structure.

Figure 14:
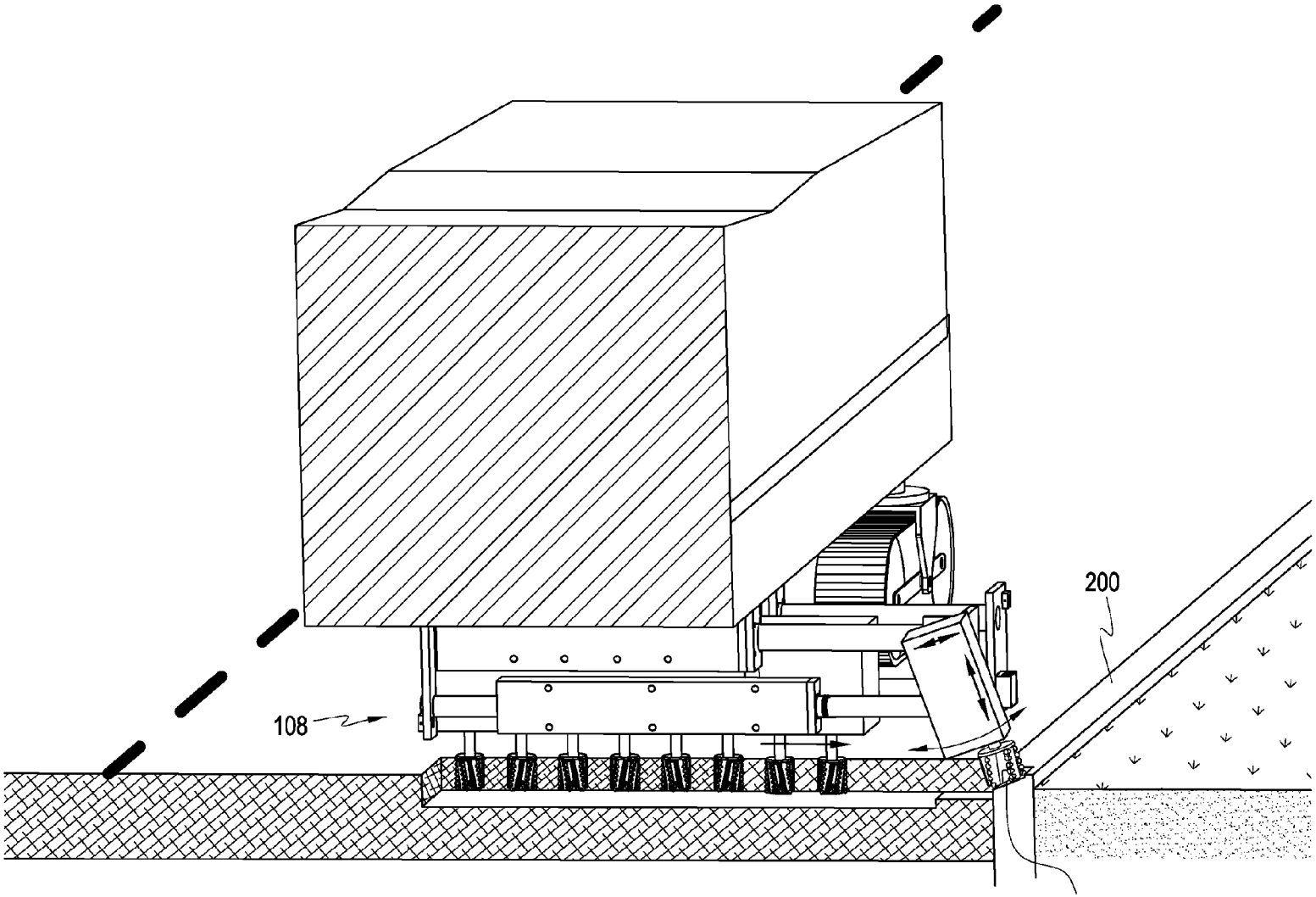
FIG. 14 is cutaway perspective view showing the contemplated movement of a trimming tool in accordance with the invention.

Referring to FIG. 14, similarly, in other embodiments, the trimming tool 120 may be rotated with respect to the support assembly 108 to cut a slanted or sloped surface into a curb 200 or other structure 200. This feature may also be helpful when cutting sloped or slanted driveways, walkways, drainage paths, or other characteristics into a curb, sidewalk, or other structure. This feature may also be useful in providing wheelchair, stroller, pedestrian, or similar access to curbs and sidewalks.

Figure 15:
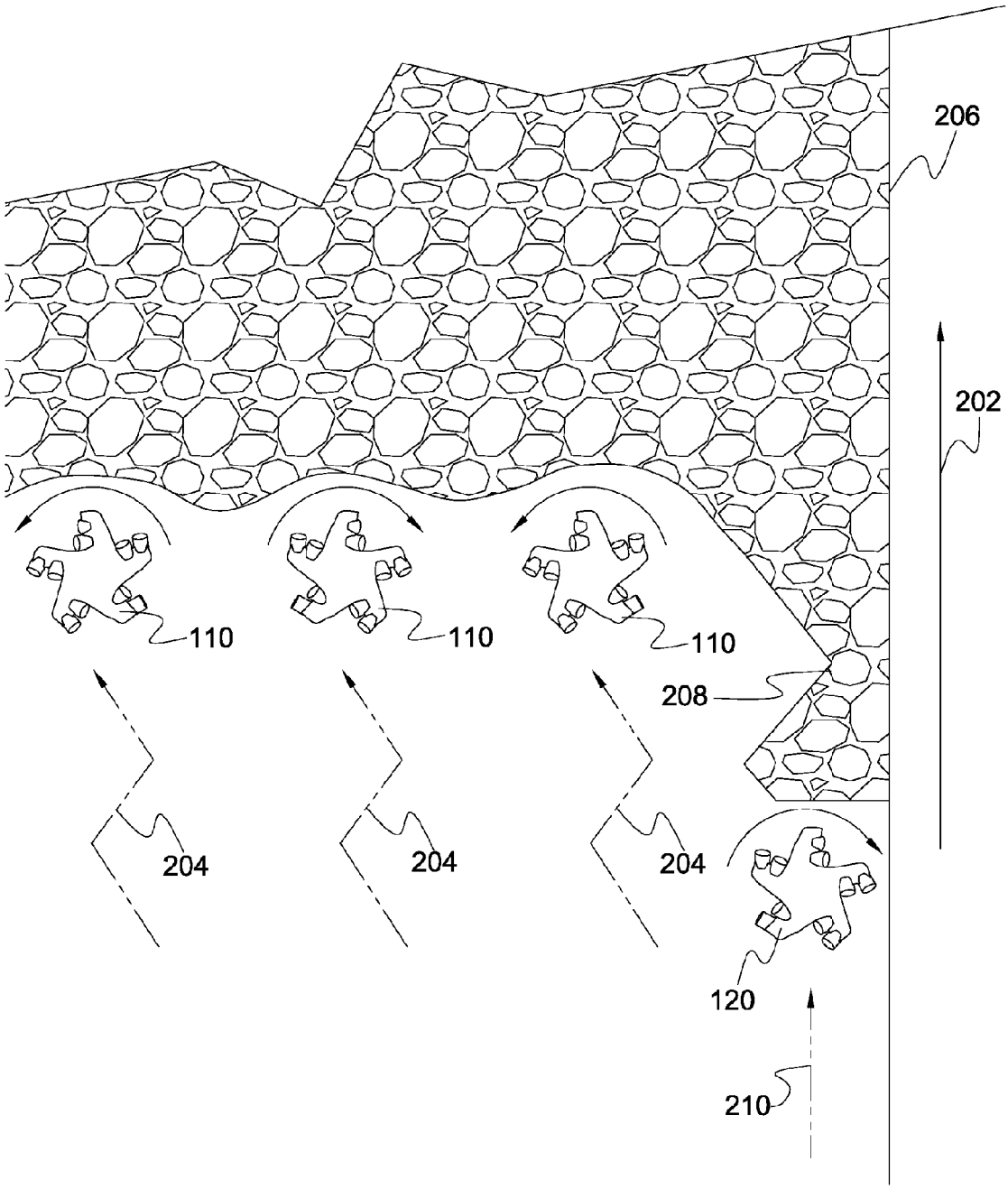
FIG. 15 is a diagram illustrating one example of the operation of trimming tool in combination with one or more pavement degradation tools.

Referring to FIG. 15, in certain embodiments, degradation tools 110 may be arranged substantially linearly with equal spacing between adjacent tools 110. Absent any side-to-side motion of the degradation tools 110, the degradation tools 110 would likely create a striated degradation pattern in a paved surface. To avoid this result, the actuator 112*b* allows the pavement degradation tools 110 to move laterally with respect to the support assembly 108. This lateral movement, combined with movement of the machine 100 in a forward or rearward direction 202, may be used to create a substantially zigzag or oscillating degradation path (illustrated by the dotted lines 204) to allow complete removal of a paved surface.

Nevertheless, while the oscillating path 204 enables removal of most of the paved surface, the oscillating path 204 may not adequately remove the edge 206 of the paved surface. Specifically, side-to-side movement of the degradation tools 110 as detailed above effectively creates a scalloped or zigzag inner boundary 208 along the paved edge 206. To remove the pavement between the boundary 208 and the edge 206, the trimming tool 120 may take a substantially linear path 210 along the outer edge 206.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. An apparatus for degrading the periphery of a paved surface, the apparatus comprising:

a support assembly;

at least one pavement degradation tool coupled to the support assembly, the at least one pavement degradation tool adapted to degrade a paved surface, thereby creating an edge; and a trimming tool coupled to the support assembly, the trimming tool adapted to degrade the edge to provide a desired contour to the edge wherein the at least one pavement degradation tool comprises is independently movable with respect to the trimming tool.

2. The apparatus of claim 1, wherein the trimming tool is adapted to straighten the edge created by the at least one pavement degradation tool.

3. The apparatus of claim 1, wherein the at least one pavement degradation tool comprises an array of pavement degradation tools.

4. The apparatus of claim 1, wherein the at least one pavement degradation tool is adapted to oscillate independent of the trimming tool.

5. The apparatus of claim 1, wherein the trimming tool is characterized by an axis of rotation, the trimming tool adapted to degrade the edge in a direction substantially normal to its axis of rotation.

6. The apparatus of claim 1, wherein the trimming tool is adapted for at least one of perpendicular, lateral, and rotational movement relative to the support assembly.

7. The apparatus of claim 1, wherein:

the support assembly is connected to a vehicle; and the support assembly is adapted to laterally extend the trimming tool with respect to the vehicle.

8. The apparatus of claim 1, wherein the support assembly comprises at least one hydraulic cylinder to move at least one of the pavement degradation tool and the trimming tool with respect to the vehicle.

9. The apparatus of claim 1, where the pavement trimming tool comprises:

a tool body having an outer circumference; and a plurality of degradation inserts coupled to the outer circumference, the degradation inserts including a material selected from the group consisting of natural diamond, synthetic diamond, polycrystalline diamond, and cubic boron nitride.

10. A system for degrading the periphery of a paved surface, the system comprising:

a vehicle;

at least one pavement degradation tool coupled to the vehicle, the at least one pavement degradation tool adapted to degrade a paved surface, thereby creating an edge; and a trimming tool coupled to the vehicle, the trimming tool adapted to degrade the edge to provide a desired contour to the edge wherein the at least one pavement degradation tool comprises is independently movable with respect to the trimming tool.

11. The system of claim 10, wherein the trimming tool is adapted to straighten the edge created by the at least one pavement degradation tool.

12. The system of claim 10, wherein the at least one pavement degradation tool comprises an array of pavement degradation tools.

13. The system of claim 10, wherein the at least one pavement degradation tool is adapted to oscillate independent of the trimming tool.

14. The system of claim 10, wherein the trimming tool is characterized by an axis of rotation, the trimming tool adapted to degrade the edge in a direction substantially normal to its axis of rotation.

15. The system of claim 10, wherein the trimming tool is adapted for at least one of perpendicular, lateral, and rotational movement relative to the vehicle.

16. The system of claim 10, further comprising a support assembly coupling the trimming tool to the vehicle.

17. The system of claim 10, wherein the support assembly comprises at least one hydraulic cylinder to move the trimming tool with respect to the vehicle.

18. The system of claim 10, where the pavement trimming tool comprises:

a tool body having an outer circumference; and a plurality of degradation inserts coupled to the outer circumference, the degradation inserts including a material selected from the group consisting of natural diamond, synthetic diamond, polycrystalline diamond, and cubic boron nitride.

* * * * *